United States Patent [19]

Weissberger

[11] 3,970,977

[45] July 20, 1976

[54] ARRANGEMENT FOR MOUNTING THE NON-SWITCHING MAGNET PART

[75] Inventor: Günther Weissberger, Riedenburg, Germany

[73] Assignee: Siemens Aktiengesellschaft, Munich, Germany

[22] Filed: Feb. 26, 1975

[21] Appl. No.: 553,137

[30] Foreign Application Priority Data

Mar. 11, 1974 Germany ..... 2411539

[52] U.S. Cl. ..... 335/132; 335/193; 335/277

[51] Int. Cl.[2] ..... H01H 50/04

[58] Field of Search ..... 335/132, 193, 202, 277, 335/278, 251, 255, 281, 133

[56] References Cited

UNITED STATES PATENTS

| | | | |
|---|---|---|---|
| 3,102,935 | 9/1963 | Christeler | 335/133 X |
| 3,295,079 | 12/1966 | Brown | 335/255 |
| 3,727,157 | 4/1973 | Grunert et al. | 335/132 |
| 3,727,160 | 4/1973 | Churchill | 335/255 |
| 3,824,509 | 7/1974 | McGary | 335/133 X |

*Primary Examiner*—George Harris
*Attorney, Agent, or Firm*—Kenyon & Kenyon Reilly Carr & Chapin

[57] ABSTRACT

An apparatus for the elastic, resilient mounting of the non-switching magnet part of an electromagnetic switching device in the direction of the magnetic force thereof, comprising a ring-shaped leaf spring which is closed in itself. More particularly, the leaf spring is arranged so as to rest against the non-switching magnet part at at least two contact areas and to rest against parts fixed relative to the housing at two further contact areas, the latter contact areas being situated on the side of the leaf spring opposite from the side resting upon the former two contact areas.

10 Claims, 3 Drawing Figures

ARRANGEMENT FOR MOUNTING THE NON-SWITCHING MAGNET PART

BACKGROUND OF THE INVENTION

1. Field of the Invention

The invention concerns an apparatus for the elastic, resilient mounting of a non-switching magnet part to the base of electromagnetic switching apparatus in the direction of the magnetic force.

2. Description of the Prior Art

In one known mounting apparatus of the above-mentioned kind (U.S. Pat. No. 3,060,355), the non-switching magnet part is penetrated, for the purpose of pressing the non-switching magnet part to parts fixed to the housing, by a latch, against which rest two separate coil springs which are braced against the housing. In the assembly of such equipment, the latch must be put in place and the separate springs placed on them and kept in their position until the equipment is assembled. In another known mounting apparatus (German Auslegeschrift No. 1,194,955), a leaf spring is employed and is placed under the non-switching magnet part to bring the latter in contact with bosses fixed to the housing. With this apparatus, however, the non-switching magnet part is not able to be moved in the direction of the magnetic force.

It is an object of the present invention to provide a mounting apparatus which is comprised of few parts and can be assembled in a simple manner.

SUMMARY OF THE INVENTION

In accordance with the principles of the present invention the above and other objectives are achieved by a mounting apparatus which includes a ring-shaped leaf spring which is closed in itself. More particularly, the leaf spring is arranged so as to rest on at least two seating or contact areas of the non-switching magnet part and on two further areas. The latter areas are situated on the side of the leaf spring opposite the side in contact with the seating areas of the non-switching magnet part and are formed by parts of the mounting apparatus which are fixed to the housing of the electromagnetic device.

Utilization of the space which is available below the magnet coil for the attachment of the non-switching magnet part can be accomplished if the leaf-ring spring rests on seating areas formed on extensions of the laminated stack of the non-switching magnet part. However, one can get along with special lamination stampings for the non-switching magnet part if the ring spring rests on areas formed on tabs bent out from the cover sheet of the non-switching magnet part. Simple lateral guidance can be achieved with a relatively long spring which runs laterally along the non-switching magnet part, if the ring spring is of rectangular shape. Detaching the magnet part from the part fixed to the housing, e.g., the base plate, is possible in a simple manner if the distance of the spring from the cover sheet of the magnet part is greater than the width of the spring web and the two pairs of seating areas are arranged and shaped in such a manner that it is possible to detach the ring spring by a lateral displacement. Damage to the leaf spring, e.g., by a notch effect at the sharp edges of the magnetic lamination, can be avoided if the ring spring is offset in the vicinity of the seating areas formed on the non-switching magnet part. Beyond this, only few laminations are bridged, so that the short-circuit turn to the rivet can be neglected and causes no appreciable increase in the power consumption. Good contact of the ring spring at the non-switching magnet part over the entire operating range can be achieved if the seating surfaces are formed on the non-switching magnet part at an angle which deviates from the normal to its direction of motion and which corresponds to about the position of the ring spring parts at half the operational travel of the spring. Automatic assembly without additional means can be accomplished if the two further contact areas are formed by tabs bent out from a base plate. For this purpose a procedure for inserting the ring spring has been found advantageous, according to which the tabs are bent into the operating position after the ring spring is inserted and tensioned.

BRIEF DESCRIPTION OF THE DRAWING

An illustrative embodiment of the present invention will be described in the detailed description hereinbelow which makes reference to the accompanying drawing in which.

DETAILED DESCRIPTION

Figure 1:
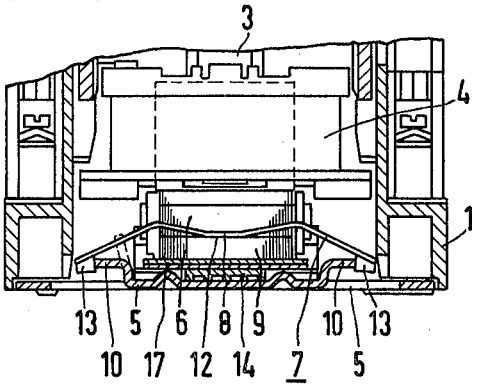
FIG. 1 shows a cross section through an electromagnetic switching device employing a mounting apparatus in accordance with the invention.

The electromagnetic switching device shown in the drawing comprises a housing 1, in which the switching magnet part 2, connected with the contact bridge carrier 3, is guided. The magnet coil 4 is put in place from below in the housing 1. The housing is closed off by a base plate 5. At this base plate 5, the non-switching magnet 6 is attached via a ring-shaped leaf spring 7. The ring-shaped leaf spring 7 is offset at its central part 8 and rests on contact or seating areas 12 formed on extensions 9 of the non-switching magnet part 6. From the base plate 5, tabs 10 are sheared out and bent off so as to provide further contact or seating areas 13, which are fixed relative to housing 1 and behind which the ring spring parts 11 are braced. In FIG. 1, the tab 10 is shown dashed in the left half in the position in which the ring-shaped leaf spring can be put in place, whereupon the tab is brought in the final assembly into the position which is shown in the figure as a solid line. This can be done by automatic machinery.

Figure 2:
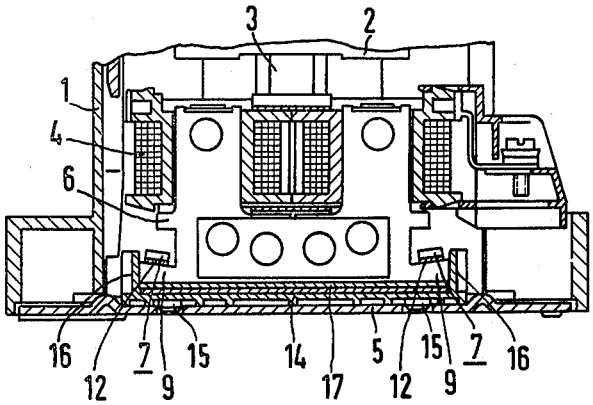
FIG. 2 shows a longitudinal cross section of the device of FIG. 1.

As shown in FIG. 2, the seating surfaces 12 are inclined in such a manner that the offset 8 of the spring 7 makes flush contact for half the travel distance of the non-switching magnet part 6 (the non-switching magnet part moves toward the switching magnet part in the switching process). This results in relatively little wear, which would occur due to the edges of the spring at the extensions 9.

In order to support the non-switching magnet part in a damped manner against the base plate 5, an intermediate damping layer 14 is placed between the non-switching magnet part 6 and the base plate 5. This intermediate layer reaches through the base plate by means of tufts or posts 15 and serves at the same time to laterally hold the non-switching magnet part with extensions 16. For equalizing the magnet travel, discs 17 can be placed between the non-switching magnet part and the intermediate damping layer 14. The discs 17 as well as the ring-shaped spring 7 are also secured against lateral displacement by the extensions 16. Lateral guidance of the spring parts 11 is provided by the walls of the housing 1. The leaf spring 7 advantageously bridges here the discs 17, i.e., the tolerance of magnet travel equalization. The impact of the switching magnet part 2 and the non-switching magnet part 6 during the switching process can be made to take place without the magnet parts resting against parts of the housing, if the force of the leaf spring 7 is designed accordingly.

Figure 3:
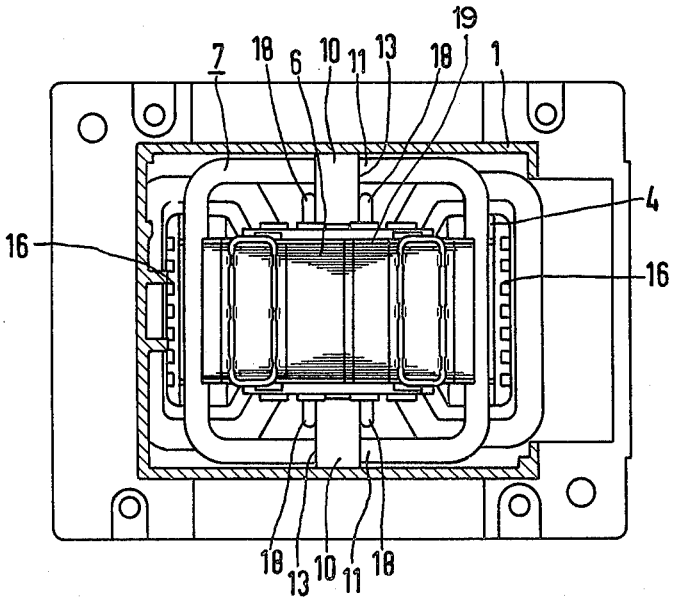
FIG. 3 illustrates a top view of the device of FIG. 1.

As shown particularly in FIG. 3, the distance from the cover sheets 19 of the non-switching magnet part 6 or the bent-up part 18 of the tabs 10 from the spring parts 11 is of such magnitude that, with the base plate taken off and with lateral displacement of the ring-shaped leaf spring 7, the spring parts 11 can emerge from under tabs 10. It is thereby possible to remove the ring-shaped leaf spring without bending the tabs 10, and, thereby, to detach the non-switching magnet part 6 from the base plate 5.

With the arrangement according to the invention, it is, therefore, possible to hold the non-switching magnet part at the base plate by the simple installation of only one part, the non-switching magnet part having been first fixed in position by an intermediate damping layer which protrudes with posts into the base plate.

What is claimed is:

1. Apparatus for use in the elastic, resilient mounting of a non-switching magnet part of an electromagnetic switching device to the base plate thereof and in the direction of the magnetic force thereof comprising:

a ring-shaped leaf spring which is closed in itself;

at least two contact areas provided on said magnet part upon which a first side of said spring rests;

and members fixed relative to the housing of said device which provide two further contact areas upon which the side of said spring opposite said first side rests.

2. Apparatus in accordance with claim 1 in which:

said magnet part includes a stack of laminations and extensions of said laminations;

and said contact areas provided by said magnet part are formed on said extensions.

3. Apparatus in accordance with claim 1 in which:

said magnet part includes a cover sheet and tabs which are bent out from said sheet;

and said contact areas provided by said magnet part are formed on said tabs.

4. Apparatus in accordance with claim 3 in which said spring has a rectangular shape.

5. Apparatus in accordance with claim 4 in which:

the distance of said spring from said sheet is larger than the width of the spring;

and said contact areas are arranged and shaped in such a manner that said spring can be detached by lateral displacement thereof.

6. Apparatus in accordance with claim 1 in which:

the portions of said spring near said contact areas provided on said magnet part are offset.

7. Apparatus in accordance with claim 6 in which:

said contact areas provided on said magnet part are at an angle which deviates from the normal to direction of motion of said part and which approximately corresponds to the position of said portions at half the operational travel of said spring.

8. Apparatus in accordance with claim 1 which further includes:

an intermediate damping layer disposed between said magnet part and said base plate, said layer having tufts which engage said base plate and extended members which fix the position of said magnet part.

9. Apparatus in accordance with claim 1 in which:

said base plate has tabs which are bent off therefrom; and said members fixed relative to the housing are formed by said tabs.

10. A method of securing a ring-shaped leaf spring to a mounting apparatus, said apparatus being of a type which is used to mount a non-switching magnet part of an electromagnetic switching device to the base plate thereof and in the direction of the magnetic force thereof and which includes said spring, at least two contact areas provided on said magnet part upon which a first side of said spring rests and tabs bent off from said base plate which provide two further contact areas upon which the side of said spring opposite said first side rests, comprising the step of:

bending said tabs into operating position after said spring is positioned and tensioned.

* * * * *